US007516566B2

(12) United States Patent
Yu

(10) Patent No.: US 7,516,566 B2
(45) Date of Patent: Apr. 14, 2009

(54) STEAM IRON HAVING A LIGHTWEIGHT SOLEPLATE AND FLAT RESISTIVE HEATING TRACKS FOR HEATING THE SOLEPLATE

(75) Inventor: Zhenhua Yu, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 121 days.

(21) Appl. No.: 10/582,907

(22) PCT Filed: Nov. 29, 2004

(86) PCT No.: PCT/IB2004/052576

§ 371 (c)(1),
(2), (4) Date: Jun. 14, 2006

(87) PCT Pub. No.: WO2005/059233

PCT Pub. Date: Jun. 30, 2005

(65) Prior Publication Data

US 2007/0157493 A1 Jul. 12, 2007

(30) Foreign Application Priority Data

Dec. 16, 2003 (EP) ..... 03104728

(51) Int. Cl.
*D06F 75/24* (2006.01)
*D06F 75/38* (2006.01)

(52) U.S. Cl. ..... 38/77.83; 38/93

(58) Field of Classification Search ..... 38/93, 38/77.83, 7.8, 77.7, 75; 219/245, 254
See application file for complete search history.

(56) References Cited

U.S. PATENT DOCUMENTS

| | | | | |
|---|---|---|---|---|
| 1,736,148 | A | 11/1929 | Brewer | |
| 2,637,126 | A * | 5/1953 | Fitzsimmons | 38/77.83 |
| 2,792,652 | A * | 5/1957 | Bertrum | 38/82 |
| 2,864,185 | A * | 12/1958 | Vance | 38/75 |
| 2,876,565 | A | 3/1959 | Jacobson | |
| 2,990,635 | A | 7/1961 | Rogers | |
| 4,196,340 | A * | 4/1980 | Evans et al. | 219/245 |
| 4,774,395 | A * | 9/1988 | Yabuuchi et al. | 392/399 |
| 5,279,054 | A * | 1/1994 | Chasen | 38/77.7 |
| 5,799,422 | A | 9/1998 | Demuth et al. | |
| 6,953,912 | B2 * | 10/2005 | Alday Lesaga | 219/251 |
| 2003/0094445 | A1 | 5/2003 | Alday Lesaga | |

(Continued)

FOREIGN PATENT DOCUMENTS

| | | |
|---|---|---|
| DE | 4107236 | 9/1992 |

(Continued)

*Primary Examiner*—Ismael Izaguirre

(57) ABSTRACT

A steam iron comprises a soleplate (1) and a separately arranged steam generator (30) having heating means (31) for heating a content of the steam generator (30). The soleplate (1) comprises an embossed area (11) for distributing the steam. As the soleplate (1) does not play a part in the process of generating steam, and does not need to comprise additional means for distributing steam, it is designed in a relatively lightweight manner, which has the advantage that the time needed for a temperature change of the soleplate (1) is relatively short. On a top surface of the embossed area (11), heating tracks for heating the soleplate (1) are arranged. As the top surface of the embossed area (11) is not capable of directly touching other objects, for example objects to be ironed, situations in which the heating tracks are subjected to severe thermal shocks are avoided.

17 Claims, 4 Drawing Sheets

FOREIGN PATENT DOCUMENTS

| | | |
|---|---|---|
| EP | 0 158 779 | 10/1985 |
| EP | 0 902 117 | 3/1999 |
| EP | 0908551 | 8/2000 |
| GB | 1 380 415 | 1/1975 |
| GB | 2 272 226 | 5/1994 |
| WO | WO199822647 | 5/1998 |

* cited by examiner

STEAM IRON HAVING A LIGHTWEIGHT SOLEPLATE AND FLAT RESISTIVE HEATING TRACKS FOR HEATING THE SOLEPLATE

The present invention relates to a steam iron, comprising a soleplate having a contacting surface for contacting objects to be ironed.

In general, a steam iron is used to iron objects, for example garments or curtains, in order to remove wrinkles from the objects. An ironing process in which a steam iron is applied involves heating the objects to be ironed and supplying steam to these objects.

Usually, in a steam iron according to the state of the art, the soleplate is formed as an aluminum casting and comprises a steam chamber in which steam is generated during operation of the steam iron. A cover is provided for closing the steam chamber. The soleplate further includes a U-shaped tubular heating element which serves for heating the soleplate during operation of the steam iron. Steam openings are arranged in communication with the steam chamber through steam distribution channels provided in the soleplate for the purpose of letting out steam during operation of the steam iron.

During operation of the known steam iron as described in the preceding paragraph, the heating element is activated, and water is supplied to the steam chamber. The heating element is controlled so as to put the temperature of the contacting surface to a predetermined level. In most cases, the obtained temperature inside the steam chamber is high enough in order to convert the water supplied to the steam chamber into steam. During an ironing process in which the steam iron is applied, the objects to be ironed are contacted by the hot contacting surface, while steam is supplied to these objects through the steam openings.

A steam iron of the type as described in the preceding paragraphs is known, for example, from EP 0 902 117. In this known steam iron, the steam openings are provided in a U-shaped steam bed which is recessed with respect to the contacting surface. Cavities having a slanting surface are provided in the steam bed for realizing an even distribution of steam in the steam bed.

Steam irons are used both in domestic environments and in industrial environments. A commonly used steam iron which is suitable for application in domestic environments comprises an internal water tank for supplying water to the steam chamber. It will be understood that the dimensions of the water tank are limited, as the steam iron is a hand-held device, which regularly needs to be lifted by a user during an ironing process. As a result of its limited dimensions, the water tank requires frequent filling, which may be bothersome to a user. Therefore, combinations of a steam iron and an external water tank have been developed, wherein the steam iron is connected to the water tank by means of a hose. The combination of the steam iron and the external water tank may be designed such that during operation cold water is supplied from the water tank to the steam iron through the hose, heating of the water taking place inside the steam iron. According to another option, the steam iron is connected to a boiler which is capable of supplying steam to the steam iron during operation. In some combinations of a steam iron and an external water tank known in practice, the external water tank is attached to an ironing board, or is designed as an integrated part of an ironing board.

Steam irons which are suitable for use in an industrial environment or for heavy-usage ironing are usually designed to be part of an ironing station. For example, such an ironing station, which is intended to be used for ironing garments, further comprises elements like one or more ironing boards, a compartment for storing ironed garments, and a boiler for supplying steam to the steam iron.

A shared feature of many types of known steam irons not connected to a boiler is that the steam chamber is integrated in the soleplate, and that the heating element serves for heating both the contacting surface and the contents of the steam chamber during operation of the steam iron. In some situations, this feature appears to be disadvantageous. For example, when a silk shirt needs to be ironed, the temperature of the contacting surface needs to be relatively low in order to prevent the silk from getting an unwanted shiny appearance. In such a case, the temperature in the steam chamber may become so low that not all water is converted into steam, as a result of which water droplets may be released by the steam iron, causing wet spots to appear on the shirt. In the process, it is even possible that scale particles are spit out by the steam iron, whereby the shirt may be stained.

In order to solve the above-mentioned problem associated with the known steam irons in which the steam chamber is integrated in the soleplate, other steam irons have been proposed comprising a separate internal steam generator, wherein the temperatures of the soleplate and the steam generator are independently controlled. A steam iron comprising a separate steam generator is known, for example, from US 2003/0094445. In this steam iron, an autonomous steam assembly is arranged which comprises a steam chamber and a separate heating element having its own thermostat for regulating the temperature in the steam chamber.

According to the present invention, a steam iron having a separate steam generator and heating means dedicated to this steam generator is provided, wherein the soleplate comprises at least one elevated surface which is located at a higher level than the contacting surface, and wherein the heating means dedicated to the soleplate are exclusively arranged on the at least one elevated surface of the soleplate.

The steam iron according to the present invention comprises a steam generator which is separately arranged with respect to the soleplate, which means that the steam generator is a separate unit which is not an integral part of the soleplate. Being a separate unit, the steam generator comprises its own heating means. The heating means of the steam generator are controlled independently of the heating means of the soleplate. Two important functions of the steam iron, i.e. providing a hot surface and generating steam, are performed independently in this way in the steam iron according to the present invention.

According to an important aspect of the present invention, the soleplate of the steam iron comprises at least one elevated surface which is located at a higher level than the contacting surface. Furthermore, the heating means associated with the soleplate are arranged on this at least one elevated surface. This design of the steam iron according to the present invention offers important advantages over the design of the known steam irons. A number of these advantages will be explained below.

Due to the fact that the steam iron according to the present invention comprises a steam generator which is separately arranged with respect to the soleplate, the soleplate does not need to comprise a steam chamber for generating steam. Moreover, the elevated surface of the soleplate may be used for delimiting a space in which steam is distributed. In a preferred embodiment of the steam iron according to the present invention, the soleplate comprises an aluminum sheet having an embossed area and at least one hole at the position of the embossed area, with heating means for heating the soleplate arranged on a top surface of the embossed area.

During operation of this steam iron, the steam generator supplies steam to the embossed area through the at least one hole. When the contacting surface of the soleplate contacts objects to be ironed, a closed space is obtained between these objects and the embossed area, in which the steam is distributed.

An important advantage of the steam iron comprising the embossed area is that the weight of its soleplate is relatively very low. An important reason in this respect is the fact that the soleplate does not need to comprise a steam chamber. Another important reason in this respect is that an outlet of the steam generator may be connected directly to the hole in the embossed area, so that it is not necessary for the soleplate to be provided with steam channels or the like. A conventional high-end soleplate having an integrated steam chamber weighs about 550 grams, whereas, according to the present invention, a weight of the soleplate of about 120 grams can be achieved.

The application of the comparatively lightweight soleplate has many advantageous aspects. A very important advantageous aspect is the fact that the lightweight soleplate according to the present invention is capable of heating up and cooling down much faster than a bulky conventional soleplate. Therefore, at the start of an ironing process, it takes less time for the steam iron according to the present invention to heat up in order to reach a state in which it is ready for use. Furthermore, at the end of an ironing process, it takes less time for the steam iron according to the present invention to cool down in order to reach a state in which it is ready to be stored. The above-mentioned advantageous aspect also plays a role during the ironing process, in particular when the temperature of the contacting surface needs to be frequently changed between different predetermined settings. The lightweight soleplate according to the present invention is capable of achieving a newly set temperature much faster than the bulky conventional soleplate.

Another advantageous aspect of the application of the lightweight soleplate according to the present invention with respect to the application of the bulky conventional soleplate is that the operation of a steam iron comprising the lightweight soleplate requires less electrical power. For example, the power required by the steam iron comprising the lightweight soleplate may be as low as 600 W. As an advantageous result, the temperature of the soleplate may be controlled in a very accurate manner, for example by means of a thermostat which alternately switches the power supply to the heating means associated with the soleplate on and off, without loading the mains too much.

In comparison with a conventional soleplate, which comprises a steam chamber and steam channels for supplying steam generated in the steam chamber to the steam openings, a soleplate which comprises only a sheet having an embossed area has a simple structure. As a result, scale removal is facilitated.

Another advantage of the new design of a steam iron is that it offers the possibility of applying flat resistive heating tracks for heating the soleplate. The fact that the heating means for heating the soleplate are arranged on the at least one elevated surface of the soleplate implies that the heating means are arranged on at least one portion of the soleplate which is not intended to directly touch the objects to be ironed. This prevents, the heating means from being subjected to severe thermal shocks, which may occur when the soleplate is heated and touches objects which are not yet heated and/or wet. Considering the fact that flat resistive heating tracks may be damaged under the influence of thermal shocks, the application of the heating tracks in the manner as proposed by the present invention enhances the reliability and the life span of the heating tracks.

The soleplate, the heating means, and the steam generator of the steam iron according to the present invention occupy less space than the soleplate, the heating element, and the cover of a conventional steam iron, especially in the case of the lightweight soleplate described above and the heating means comprising flat resistive heating tracks. As a result, a steam iron according to the present invention can be smaller than a conventional steam iron. If the overall dimensions of the steam iron are not substantially changed, additional space is obtained, which may be used, for example, for accommodating an additional portion of an internal water tank.

A steam iron comprising flat resistive heating tracks for heating the soleplate is known from GB 2 272 226. Contrary to the steam iron according to the present invention, the steam iron known from GB 2 272 226 does not comprise a separate steam generator. Instead, a portion of a top surface of the soleplate constitutes a water heating surface, which is part of a steam-producing means.

The flat resistive heating tracks of the steam iron known from GB 2 272 226 comprise left- and right-hand track portions and a water-heating track portion, which track portions are independently controlled. Temperature-sensing resistive tracks are provided for separate sensing of the temperatures of an ironing portion of the soleplate and a water-heating portion of the soleplate, which the water heating portion comprises the water-heating surface. The left- and right-hand track portions are associated with the ironing portion of the soleplate, whereas the water-heating track portion is associated with the water-heating surface of the soleplate.

Since the water-heating track portion is associated with the water-heating surface, and the water-heating surface is part of the soleplate in the steam iron known from GB 2 272 226, the temperature of the iron portion of the soleplate is inevitably influenced by an actuation of the water-heating track portion. Also, the temperature of the water-heating surface is inevitably influenced by an actuation of the left- and right-hand track portions.

Therefore, in order to obtain desired temperatures of the ironing portion of the soleplate on the one hand and the water-heating portion of the soleplate on the other hand, a circuit for controlling the temperatures of these portions of the soleplate needs to make use of information supplied by the temperature-sensing resistive tracks.

Compared with the steam iron known from GB 2 272 226, the steam iron according to the present invention offers the advantage that the function of generating steam and the function of providing a hot surface for contacting objects to be ironed are completely separated. It may be true that the steam iron known from GB 2 272 226 has track portions which are intended for heating an ironing portion of the soleplate and separate track portions which are intended for heating a water heating surface of the soleplate, but that does not alter the fact that both types of track portions are associated with the soleplate, so that the temperature of the soleplate is influenced by both types of track portions during operation.

Furthermore, the soleplate of the steam iron known from GB 2 272 226 does not comprise an elevated surface, and the heating tracks are arranged directly on portions of the soleplate which are used to touch objects to be ironed during an ironing process. Consequently, the heating tracks are subjected to severe thermal shocks during the ironing process, which may cause the heating tracks to break down. The occurrence of severe thermal shocks is also related to the fact that the steam is generated by a steam-producing means comprising a portion of a top surface of the soleplate.

The present invention will now be explained in greater detail with reference to the Figures, in which similar parts are indicated by the same reference signs, and in which.

FIGS. 1 -4 show a soleplate 1 for a steam iron according to a first preferred embodiment of the present invention. This soleplate 1 will be referred to as first soleplate 1 below for the sake of simplicity.

The first soleplate 1 comprises a sheet 10 having an embossed area 11. The sheet 10 preferably comprises a lightweight metal such as aluminum. A circumference of the sheet 10 is shaped in a conventional manner. The embossed area 11 is V-shaped in the example shown.

Figure 1:
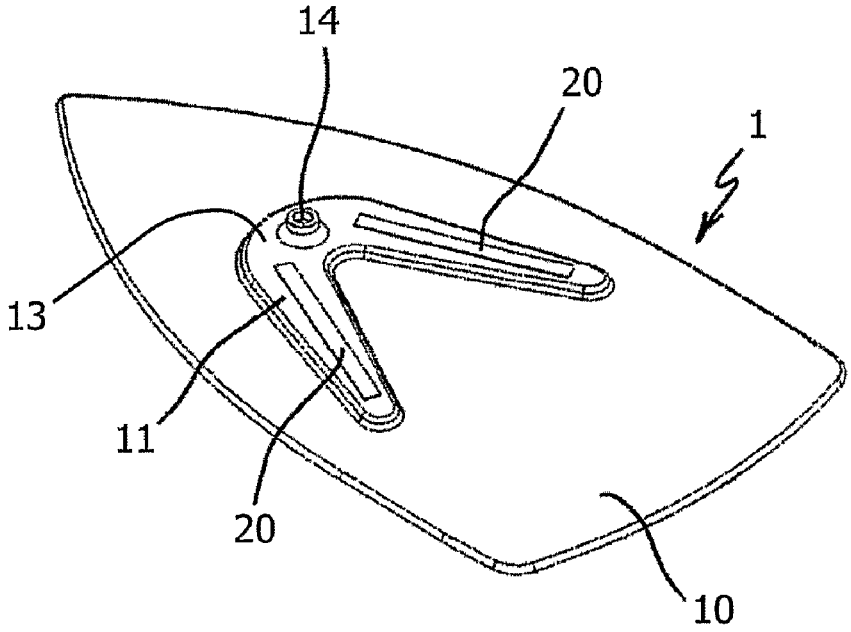
FIG. 1 is a perspective view of a soleplate for a steam iron according to a first preferred embodiment of the present invention.

A side of the first soleplate 1 where the embossed area 11 forms a recess will be referred to as bottom side, and a side of the first soleplate 1 where the embossed area 11 forms a bulge will be referred to as top side below. At the bottom side, the first soleplate 1 comprises a substantially planar contacting surface 12. During operation of a steam iron (not shown as a whole) comprising the first soleplate 1, the contacting surface 12 serves for contacting and heating objects to be ironed. Heating means are provided for the purpose of heating the first soleplate 1 during operation of the steam iron. According to an important aspect of the present invention, the heating means comprise flat resistive heating tracks 20. These heating tracks 20 are exclusively located on a top surface 13 of the embossed area 11, as shown in FIG. 1.

Figure 3:
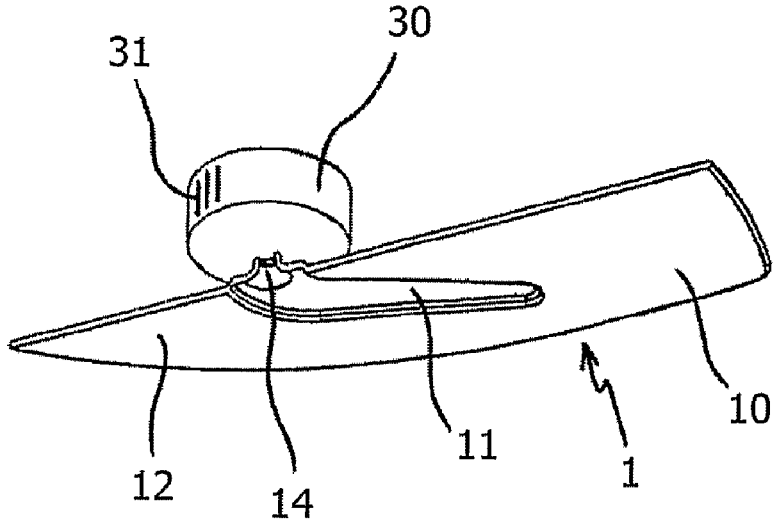
FIG. 3 is a perspective view of a steam generator and a section of the soleplate as shown in FIG. 1.

An opening 14 is provided in the embossed area 11, which opening will be denoted the steam inlet 14. In particular, the steam inlet 14 is provided at a base of the V-shaped embossed area 11. During operation of a steam iron comprising the first soleplate 1, steam is supplied to the bottom side of the embossed area 11 via the steam inlet 14. The steam is generated by a steam generator 30, which is shown in FIG. 3 and which also forms part of the steam iron comprising the first soleplate 1. In this steam iron, the steam inlet 14 is in direct communication with a steam outlet (not shown) of the steam generator 30. It will be understood that the steam generator 30 is connected to a water tank (not shown) or the like, which is arranged for the purpose of supplying water to the steam generator 30.

Within the scope of the present invention, it is not necessary that the steam inlet 14 is in direct communication with the steam outlet of the steam generator 30. Instead, the communication between the steam inlet 14 and the steam outlet of the steam generator 30 may be realized through a short steam hose, for example. However, a direct communication between the steam inlet 14 and the steam outlet of the steam generator 30 is preferred, as condensation of the steam is avoided in this way.

When a steam iron comprising the first soleplate 1 and the steam generator 30 is used for ironing objects, both the steam generator 30 and the heating tracks 20 are activated. The first soleplate 1 is heated as a result of the activation of the heating tracks 20. Steam is generated as a result of the activation of the steam generator 30. The generated steam is supplied to the bottom side of the embossed area 11 via the steam inlet 14 in the process.

A space which is present between the first soleplate 1 at the position of the embossed area 11 and the objects to be ironed serves as a steam distribution channel. During an ironing process, the steam iron will be moved by a user most of the time such that a portion of the embossed area 11 having the steam inlet 14 is succeeded by the other portions of the embossed area 11, which are formed as the legs of the V-shaped embossed area 11. A good distribution of the steam in the steam distribution channel is obtained in this way under the influence of the movement of the steam iron, wherein the steam does not only fill the base of the V-shaped steam distribution channel where the steam inlet 14 is located, but also fills the legs of said channel.

During the ironing process, a user moves the steam iron such that the contacting surface 12 glides along the objects to be ironed. In the process, the objects are heated up by the contact with the hot contacting surface 12. Furthermore, the objects are put in contact with the steam which is present at the bottom side of the embossed area 11. Wrinkles are removed from the objects thereby.

As the heating tracks 20 are arranged on the top surface 13 of the embossed area 11, i.e. on a portion of the first soleplate 1 which is not capable of directly touching the objects to be ironed, the heating tracks 20 are prevented from being subjected to severe thermal shocks which may cause damage to the heating tracks 20.

During operation of the steam iron, water is continually supplied to the steam generator 30, where it is heated and converted into steam. The water may be coming from a water tank which is arranged inside the steam iron comprising the first soleplate 1 and the steam generator 30, or it may alternatively be coming from an external water tank. Like conventional steam irons, the steam iron comprising the first soleplate 1 and the steam generator 30 may be equipped with a valve or the like which is arranged between the steam outlet of the steam generator 30 and the steam inlet 14 provided in the first soleplate 1, so that it is possible for a user of the steam iron to control the quantity of steam the objects to be ironed are subjected to.

For the purpose of heating the water, the steam generator 30 comprises heating means, which are diagrammatically depicted in FIG. 3 and indicated by reference numeral 31. These heating means 31 are exclusively associated with the steam generator 30 and are not capable of influencing a temperature of the first soleplate 1, as the steam generator 30 is separately arranged with respect to the first soleplate 1. Due to the fact that the first soleplate 1 and the steam generator 30 are separate, independent units, the heating tracks 20 are only capable of influencing the temperature of the first soleplate 1 and do not play any part in the process of heating water in order to generate steam, which takes place in the steam generator 30 during operation.

In a steam iron comprising the first soleplate 1 and the steam generator 30, it is possible to inject water into a steam flow between the outlet of the steam generator 30 and the steam inlet 14. It is possible in this way to obtain so-called wet steam, which is a mixture of steam and water droplets. In conventional steam irons, in which the steam is generated in a chamber which is provided in the soleplate, this is hardly possible, as additionally injected water would be evaporated as a result of the temperature of the soleplate in most cases.

The first soleplate 1 according to the present invention is manufactured from a thin sheet 10. As a consequence, the first soleplate 1 comprises a relatively small amount of material. If the sheet 10 comprises aluminum, the first soleplate 10 may be relatively very light. For example, a first soleplate 10 of conventional circumferential dimensions will weigh no more than 120 grams. Taking into consideration the fact that a conventional high-end soleplate comprising an integrated steam chamber normally weighs about 550 grams, it is clear that the first soleplate 10 according to the present invention is considerably lighter than the conventional soleplate.

The lightweight design of the first soleplate 1 according to the present invention means that the time needed for a temperature change of the soleplate 1 is relatively short. Therefore, temperature changes which are needed during an ironing process, for example when one object to be ironed is replaced by another object to be ironed, the materials of the successive objects being mutually different, can be realized relatively fast. Also, both heating-up of the soleplate 1 at the start of an ironing process and cooling-down of the soleplate 1 at the end of an ironing process do not take much time.

Experiments have shown that a temperature change during an ironing process can be realized in 15 seconds, so that it is very easy to alternate between different types of material, such as cotton and synthetic fibers. Heating up the first soleplate 1 according to the present invention takes approximately 20 seconds. Therefore, a steam iron comprising this soleplate 1 is ready for use very quickly. Much time is saved, in comparison with situations in which conventional steam irons are used, as in such situations getting ready for use normally takes minutes. If a conventional steam iron is connected to a boiler for providing steam, it may take 2 or 3 minutes, or even 9 minutes before the ironing process can be started, depending on the actual construction. Cooling down the first soleplate 1 according to the present invention takes approximately 4 to 5 minutes, and approximately only 15 seconds when pressed against a cool surface. These are also comparatively short times; the soleplate according to the state of the art normally takes about 30 minutes to cool down, and approximately 4 to 5 minutes when pressed against a cool surface.

In comparison with a conventional soleplate having a number of steam openings, the first soleplate 1, is easy to clean, having only a single steam inlet 14 and an embossed area 11 for distributing the steam at the bottom side of the first soleplate 1, which embossed area 11 covers a substantial portion of the soleplate 1. Moreover, scale hardly has an opportunity to accumulate.

Figure 2:
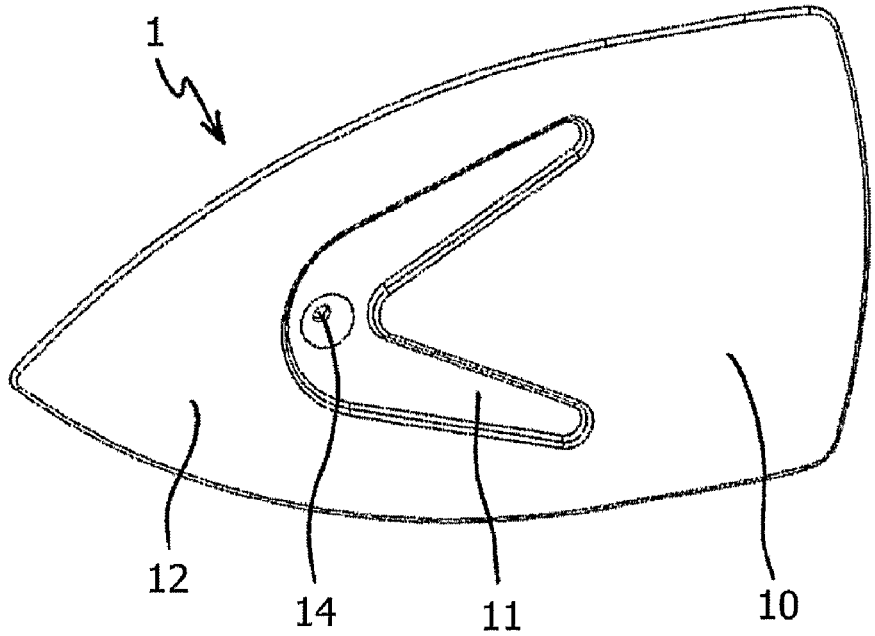
FIG. 2 is another perspective view of the soleplate as shown in FIG. 1.
Figure 4:
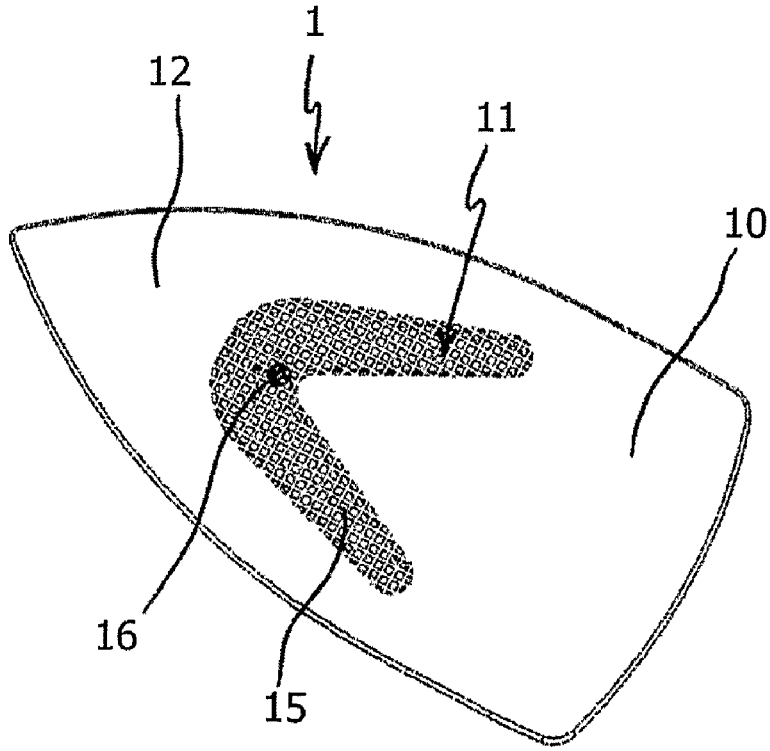
FIG. 4 is a bottom view of the soleplate as shown in FIG. 1, comprising a wire mesh.
Figure 5:
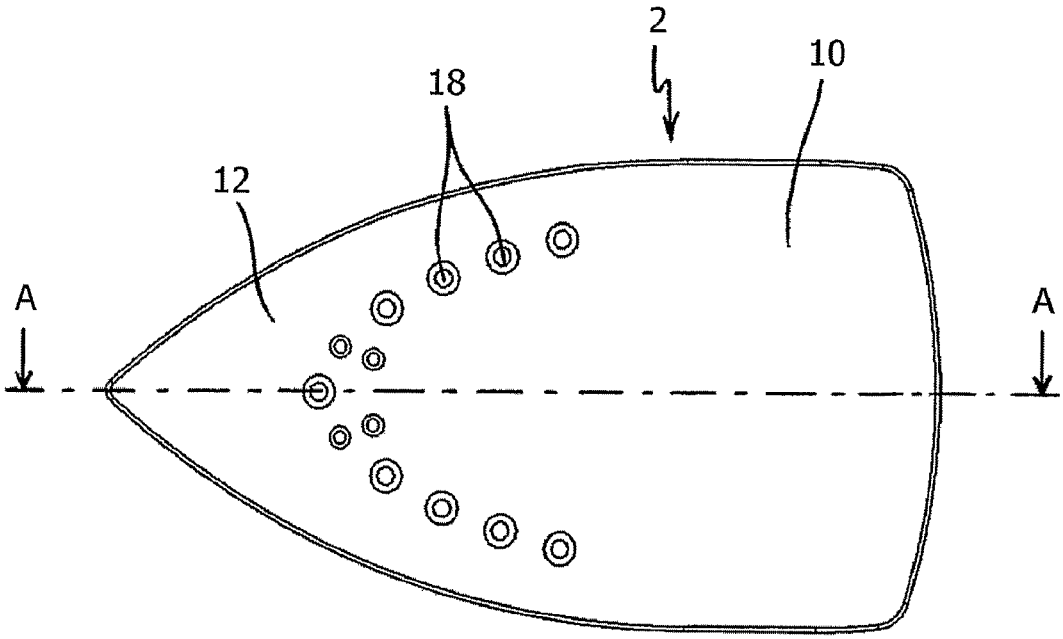
FIG. 5 is a bottom view of a soleplate for a steam iron according to a second preferred embodiment of the present invention.

The manufacturing process of the first soleplate 1 uses a starting material comprising a sheet having a circumference such as shown in FIGS. 1, 2, and 4 as the sheet 10 of the first soleplate 1, which circumference is conventional in the field of irons and soleplates for irons. The sheet may be obtained from a larger sheet, for example by means of stamping or punching.

The manufacturing process of the first soleplate 1 comprises the steps of embossing the starting material, such that the embossed area 11 is formed, and providing a hole in the embossed area 11, for example by means of punching, such that the steam inlet 14 is formed. Preferably, the manufacturing process also comprises the step of coating a bottom side of the sheet 10 with the exception of the embossed area 11. In this way, a first soleplate 1 having a smooth contacting surface 12 is obtained, so that situations in which the contacting surface 12 sticks to the objects to be ironed may be avoided.

After the first soleplate 1 has been formed, the heating tracks 20 are deposited on the top surface 13 of the embossed area 11 by means of printing or some other suitable technique. If printing techniques are applied, it is important that the top surface 13 of the embossed area 11 is planar, or at least comprises planar portions.

FIG. 4 shows the bottom side of the first soleplate 1, where the embossed area 11 is covered by a wire mesh 15. The wire mesh 15 serves as a mask for the embossed area 11, thereby improving the aesthetic perception of the appearance of the bottom side of the first soleplate 1. A mesh density may be chosen such that the wire mesh 15 is also capable of functioning as a scale collector. In the example shown, the wire mesh 15 is attached to the embossed area 11 by means of a screw 16. In this way, all that is needed for taking off the wire mesh 15 in order to clear away the scale is turning the screw 16 by means of a screwdriver or the like.

Instead of screws, other easily accessible fasteners may be used for fixing the wire mesh 15. For example, fasteners capable of realizing a snap connection between the wire mesh 15 and the embossed area 11 may be used. Preferably, such fasteners are designed such that a user is capable of detaching the snap connection without the use of additional tools.

In FIGS. 5-8 show a soleplate 2 for a steam iron according to a second preferred embodiment of the present invention. This soleplate 2 will be referred to as second soleplate 2 below for the sake of simplicity.

The second soleplate 2 comprises a sheet 10 in which a number of openings 18 are arranged. These openings 18 will be denoted steam openings 18 below. The steam openings 18 may be positioned in any suitable pattern. In this example, an overall shape of the pattern of steam openings 18 resembles the shape of a V. The number of steam openings 18 may have any suitable value.

At one side of the sheet 10, a canopy 25 is present which comprises an upright wall 26 forming a closed loop and a roof plate 27 covering the space encompassed by the upright wall 26. The space which is delimited by the canopy 25 and the sheet 10 is referred to as canopy chamber 28.

In the following, the side where the canopy 25 is present is referred to as top side, whereas the other side is referred to as bottom side. It will be clear that a contacting surface 12 for contacting objects to be ironed by means of a steam iron comprising the second soleplate 2 is present at the bottom side.

Figure 6:
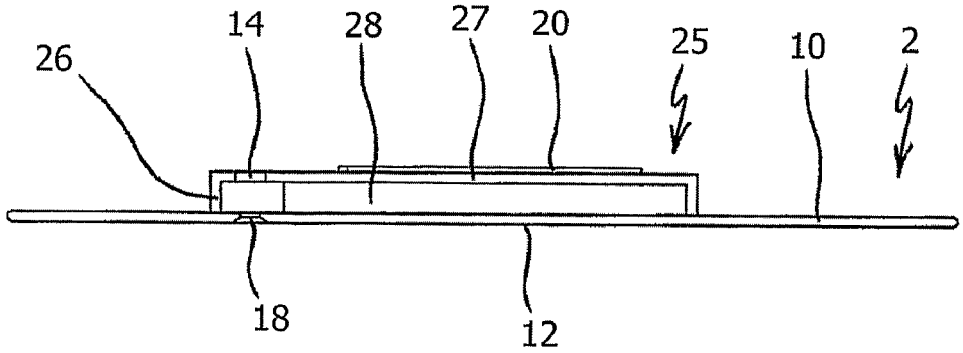
FIG. 6 is a view of a section taken on the line A-A in FIG. 5.
Figure 7:
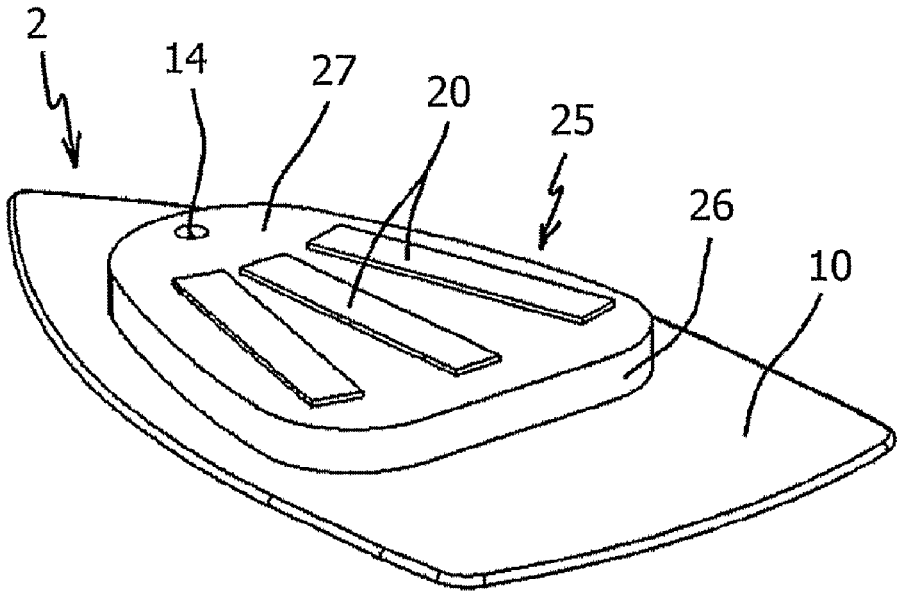
FIG. 7 is a perspective view of the soleplate as shown in FIG. 5.
Figure 8:
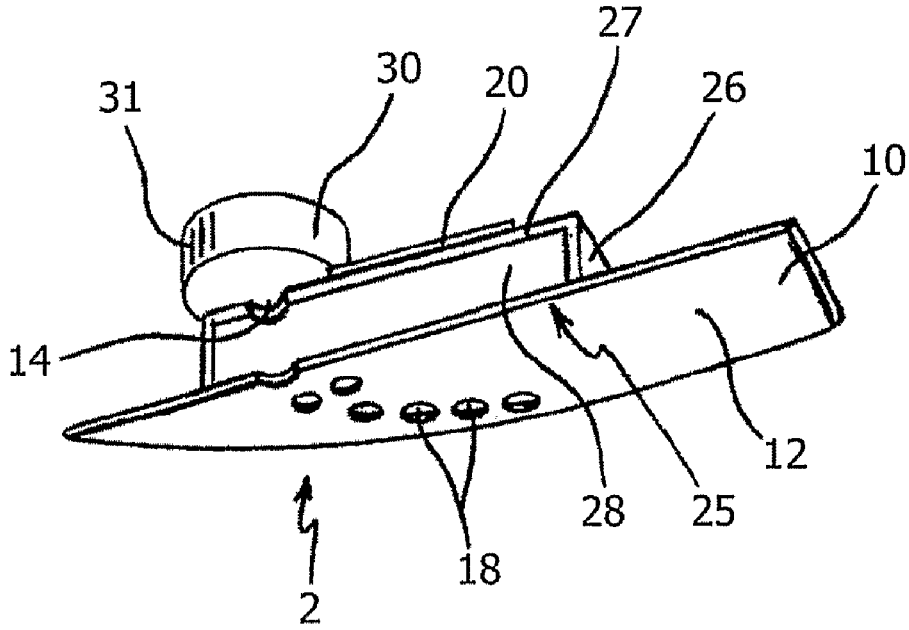
FIG. 8 is a perspective view of a steam generator and a section of the soleplate as shown in FIG. 5.

Heating means are provided for the purpose of heating the second soleplate 2 during operation of a steam iron comprising the second soleplate 2. According to an important aspect of the present invention, the heating means comprise flat resistive heating tracks 20. These heating tracks 20 are exclusively located on the roof plate 27 of the canopy 25, as shown in FIGS. 6-8.

In the roof plate 27 of the canopy 25, an opening 14 is provided which will be referred to as steam inlet 14 below. During operation of a steam iron comprising the second soleplate 2, steam is supplied to the canopy chamber 28 via the steam inlet 14. The steam is generated by a steam generator 30 which also forms part of the steam iron comprising the second soleplate 2. The steam generator 30 is shown in FIG. 8. In the steam iron, the steam inlet 14 is in direct communication with a steam outlet (not shown) of the steam generator 30.

During operation of a steam iron comprising the second soleplate 2 and the steam generator 30, the second soleplate 2 is heated by means of the heating tracks 20, and steam is generated by the steam generator 30. In the process, the generated steam is supplied to the canopy chamber 28 via the steam inlet 14. The steam is distributed inside the canopy chamber 28, after which the steam is supplied to the objects to be ironed through the steam openings 18.

As the heating tracks 20 are arranged on top of the roof plate 27 of the canopy 25, i.e. on a portion of the second soleplate 2 not capable of directly touching the objects to be ironed, the heating tracks 20 are prevented from being subjected to severe thermal shocks which may cause damage to the heating tracks 20.

Like a steam iron comprising the first soleplate 1 and the steam generator 30, a steam iron comprising the second soleplate 2 and the steam generator 30 may be equipped with an internal water tank for containing water that is to be supplied to the steam generator 30 during operation, but it may also be used in combination with an external water tank. Furthermore, the latter steam iron may also be equipped with a valve or the like, which may be controlled by a user in order to subject the objects to be ironed to a predetermined dose of steam.

The steam generator 30 used in combination with the second soleplate 2 corresponds to the steam generator 30 used in combination with the first soleplate 1. Therefore, the steam generator 30 as shown in FIG. 8 also comprises heating means 31 which are exclusively associated with this steam generator 30. Furthermore, the heating means 31 of the steam generator 30 and the heating tracks 20 located on the second soleplate 2 are again independently controlled. Consequently, the temperature of the second soleplate 2 is exclusively set by means of the heating tracks 20 in a steam iron comprising the second soleplate 2 and the steam generator 30, whereas the temperature prevailing in the steam generator 30 is exclusively set by the heating means 31. In this way, two important functions of the steam iron, i.e. providing a hot contacting surface 12 and providing steam, are independently performed by the steam iron during operation.

The weight of the second soleplate 2 is somewhat higher than the weight of a first soleplate 1 having comparable dimensions. Nevertheless, the weight of the second soleplate 2 is substantially lower than the weight of a conventional soleplate formed as a casting and comprising an integrated steam chamber. Therefore, the advantage of the time needed for a temperature change being relatively short, which has already been described with respect to the first soleplate 1, also applies to the second soleplate 2.

It will be clear to those skilled in the art that the scope of the present invention is not limited to the examples discussed above, but that several amendments and modifications thereof are possible without deviating from the scope of the present invention as defined in the attached claims.

In particular, the shape of the embossed area 11 of the first soleplate 1 and the pattern in which the steam openings 18 of the second soleplate 2 are positioned may be different from what has been shown and described in the foregoing.

The number of heating tracks 20 is not essential; the soleplates 1, 2 may comprise more or fewer heating tracks 20 than shown in the Figures.

In the example shown, the first soleplate 1 comprises only one embossed area 11. This does not alter the fact that the first soleplate 1 may comprise more embossed areas 11. Each embossed area 11 may be provided with a steam inlet 14, so that the steam generated by the steam generator 30 is directly supplied to the various embossed areas 11. However, it is also possible that the embossed areas 11 are interconnected, so that the steam is supplied from one embossed area 11 to another embossed area 11. In a similar manner, the second soleplate 2 may comprise more than one canopy 25.

In a practical embodiment, the heating means 31 of the steam generator 30 may comprise, for example, flat resistive heating tracks which are arranged on top of the steam generator 30.

In the examples shown, the steam generator 30 is positioned inside the steam iron in a location right above the soleplate 1, 2, so that the steam outlet of the steam generator 30 can be in direct communication with the steam inlet 14 of the soleplate 1, 2. An advantage of this position of the steam generator 30 is that condensation of the steam is avoided. However, this does not alter the fact that it is not necessary for the steam generator 30 to be positioned close to the soleplate 1, 2. Within the scope of the present invention, it is also possible that the steam generator 30 is positioned outside the steam iron, and that a steam hose is arranged for interconnecting the steam outlet of the steam generator 30 and the steam inlet 14 of the soleplate 1, 2. In such a case, the steam generator 30 may be located, for example, in a stand or in an ironing board.

The upper surface 13 of the embossed area 11 of the first soleplate 1 may be planar, as shown, or curved, depending on the techniques used for depositing the heating tracks 20 on said upper surface 13. The same is true for the roof plate 27 of the canopy 25 of the second soleplate 2.

It is noted that the terms "water" and "steam" used above do not only pertain to the liquified state and the vaporized state of water, but also to said states of any suitable mixture containing water, for example a mixture containing water and an artificial odor.

A steam iron comprising a first soleplate 1 and a steam generator 30 were described above. The steam generator 30 is separately arranged with respect to the first soleplate 1 and comprises heating means 31 which are exclusively intended for heating a content of the steam generator 30.

The first soleplate 1 comprises an embossed area 11 for distributing the steam. Heating tracks 20 for heating the first soleplate 1 are arranged on a top surface 13 of the embossed area 11. As the top surface 13 of the embossed area 11 is not capable of directly touching other objects, for example objects to be ironed, situations in which the heating tracks 20 are subjected to severe thermal shocks which may cause damage to the heating tracks 20 are avoided.

The heating tracks 20 for heating the first soleplate 1 and the heating means 31 of the steam generator 30 are independently controllable. In this way, the function of providing a hot surface 12 for contacting objects to be ironed is separated from the function of generating steam. As the first soleplate 1 does not play a part in the process of generating steam, and does not need to comprise additional means for distributing steam, such as steam distribution channels or the like, it is designed in a relatively lightweight manner, which has the advantage that the time needed for a temperature change of the first soleplate 1 is relatively short.

The invention claimed is:

1. A steam iron, comprising:

a soleplate having a contacting surface for contacting objects to be ironed, and at least one elevated surface which is located at a higher level than the contacting surface;

a steam generator for generating steam, which is separately arranged with respect to the soleplate; and two separately controllable heating means wherein a first of the heating means is associated with the soleplate and is arranged for heating the soleplate and wherein a second of the heating means is associated with the steam generator and is arranged for heating a content of the steam generator;

wherein the heating means associated with the soleplate are exclusively arranged on the at least one elevated surface of the soleplate.

2. A soleplate for a steam iron according to claim 1, comprising a substantially planar sheet and at least one embossed area provided in said sheet.

3. The steam iron of claim, wherein the heating means associated with the soleplate comprise at least one flat resistive heating track.

4. The stream iron of claim 1, wherein the at least one elevated surface of the soleplate forms a recess in the soleplate viewed from a contacting side of the soleplate facing the objects to be ironed.

5. The steam iron of claim 4, wherein the recess is designed for use as a steam distribution channel during operation of the steam iron.

6. A steam iron, comprising:

a soleplate having a contacting surface for contacting objects to be ironed, and at least one elevated surface which is located at a higher level than the contacting surface;

a steam generator for generating steam, which is separately arranged with respect to the soleplate; and two separately controllable heating means wherein a first of the heating means is associated with the soleplate and is arranged for heating the soleplate and wherein a second of the heating means is associated with the steam generator and is arranged for heating a content of the steam generator;

wherein at least one embossed area which is provided in the soleplate and which forms a recess at a bottom side of the soleplate wherein the recess is designed for use as a steam distribution channel during operation of the steam iron, and wherein the heating means associated with the soleplate are exclusively arranged on the at least one elevated surface of the soleplate.

7. Steam iron according to claim 6, wherein the heating means associated with the soleplate are arranged on a top surface of the embossed area.

8. The steam iron of claim 7, wherein the heating means associated with the soleplate comprise at least one flat resistive heating track.

9. Steam iron according to claim 6, comprising a wire mesh for covering a bottom side of the embossed area.

10. The steam iron of claim 9, wherein the heating means associated with the soleplate comprise at least one flat resistive heating track.

11. Steam iron according to claim 9, wherein the wire mesh is attached to the soleplate by means of detachably arranged fastening means.

12. The steam iron of claim 11, wherein the heating means associated with the soleplate comprise at least one flat resistive heating track.

13. The steam iron of claim 6, wherein the heating means associated with the soleplate comprise at least one flat resistive heating track.

14. A steam iron, comprising:

a soleplate having a contacting surface for contacting objects to be ironed, and at least one elevated surface which is located at a higher level than the contacting surface;

a steam generator for generating steam, which is separately arranged with respect to the soleplate; and two separately controllable heating means wherein a first of the heating means is associated with the soleplate and is arranged for heating the soleplate and wherein a second of the heating means is associated with the steam generator and is arranged for heating a content of the steam generator;

wherein the heating means associated with the soleplate are exclusively arranged on the at least one elevated surface of the soleplate, wherein the soleplate comprises at least one steam opening for letting through steam to the objects to be ironed, and at least one canopy covering said at least one steam opening whereby a canopy chamber is delimited which is designed for use as a steam distribution chamber during operation of the steam iron, and wherein the heating means associated with the soleplate are arranged on a roof plate of the canopy.

15. A soleplate for a steam iron according to claim 14, comprising a substantially planar sheet, at least one steam opening arranged in said sheet, and at least one canopy covering said at least one steam opening.

16. The steam iron of claim 14, wherein the at least one elevated surface of the soleplate forms a recess in the soleplate viewed from a contacting side of the soleplate facing the objects to be ironed.

17. The steam iron of claim 16, wherein the recess is designed for use as a steam distribution channel during operation of the steam iron.

* * * * *